United States Patent [19]

De Volder et al.

[11] 4,147,812

[45] Apr. 3, 1979

[54] ELECTROPHORETIC DEVELOPMENT

[75] Inventors: Noel J. De Volder, Edegem; Yvan K. Gilliams, Hever, both of Belgium

[73] Assignee: AGFA-GEVAERT N.V., Mortsel, Belgium

[21] Appl. No.: 723,178

[22] Filed: Sep. 14, 1976

[30] Foreign Application Priority Data

Sep. 16, 1975 [GB] United Kingdom ..... 38068/75
Jan. 30, 1976 [GB] United Kingdom ..... 3805/76

[51] Int. Cl.[2] ..... G03G 13/10; G03G 9/12

[52] U.S. Cl. ..... 427/17; 96/1 LY; 252/62.1 L

[58] Field of Search ..... 427/15, 17; 96/1 LY; 252/62.1 L

[56] References Cited

U.S. PATENT DOCUMENTS

| | | | |
|---|---|---|---|
| 3,537,996 | 11/1970 | Holst et al. | 252/33 |
| 3,576,744 | 4/1971 | Sharrock et al. | 252/62.12 |
| 3,707,360 | 12/1972 | Eckert | 44/51 |
| 3,890,240 | 6/1975 | Hochberg | 252/62.1 L |
| 3,969,238 | 7/1976 | Tsuneda | 252/62.1 L |
| 3,997,456 | 12/1976 | Voss et al. | 252/62.1 L |
| 3,998,746 | 12/1976 | Tsuneda | 252/62.1 L |

OTHER PUBLICATIONS

*Industrial and Engineering Chemistry*, vol. 46, No. 5, 1954, "Neutral and Basic Sulphonates", Hayward R. Baker et al., pp. 1035–1036.

*Primary Examiner*—Michael F. Esposito
*Assistant Examiner*—Stuart D. Frenkel
*Attorney, Agent, or Firm*—William J. Daniel

[57] ABSTRACT

A liquid developer composition suitable for rendering visible in the direct or reversed sense electrostatic charge patterns contained on a surface, which composition contains in a hydrocarbon liquid having a volume resistivity of at least $10^9$ Ohm.cm and a dielectric constant of less than 3, a negatively charged suspended toner comprising pigment particles bearing organic polymeric material on their surfaces and at least one organic ionic surfactant, wherein (1) said organic ionic surfactant is an oil-soluble overbased alkaline earth metal hydrocarbon sulphonate wherein the alkaline earth metal is magnesium, calcium or barium, the sulphonate has an average molecular weight of at least 800, and the total base number (TBN) of the surfactant determined according to ASTM D 664-58 is at least 2, and (2) the polymeric material is a copolymer of (A) a $C_{12}$–$C_{20}$ alkyl alcohol ester of methacrylic acid and (B) n-butyl or isobutyl alcohol ester of methacrylic acid in which the ratio by weight of (A)/(B) is in the range of 15–85/85–15 or the same copolymer containing in its structure styrene or styrene homologue units up to maximum 70% by weight the copolymer in either case optionally containing up to 0.4% by weight of methacrylic acid units.

10 Claims, No Drawings

ELECTROPHORETIC DEVELOPMENT

The present invention relates to electrostatography and more particularly to a method for the development of positively charged electrostatic charge patterns in the direct sense and negatively charged electrostatic charge patterns in the reverse sense and to liquid developers used therefor.

An electrostatographic process known as electrophotography comprises the steps of electrostatically charging in the dark a photoconductive surface and image-wise exposing said surface, whereby the irradiated areas become discharged in accordance with the intensity of radiation, thus forming a latent electrostatic image. The formation of a visible image proceeds by supplying to the image-wise charged material a finely divided electroscopic material known as "toner". The "toner" is image-wise electrostatically attracted or repulsed so that a direct or reversal toner image of the pattern represented by the charge density distribution is obtained. The toner image may be fixed to the surface of the photoconductor or transferred to another surface and fixed thereon.

Instead of forming the electrostatic image by the steps described above it is also possible to charge directly a dielectric material in image configuration e.g. with a charged stylus, or through photo-electron emission or ionography.

Historically, a one-component dry powder toner was first used for developing electrostatic images. Other development processes, presently known as cascade, fur brush, powder cloud, magnetic brush and liquid electrophoretic development were introduced.

Developers of the electrophoretic type initially comprised basically a simple dispersion of a pigment without binder. It was later proposed, e.g. by Metcalfe and Wright, J. Oil Colour Chem. Ass., 39 (1956) 851–853, to use liquid developers incorporating resins and control agents. The resultant images are then made of so-called "self-fixing" toners.

In liquid developers comprising coloured toner particles suspended in an insulating carrier liquid, the volume resistivity of the liquid is preferably in excess of $10^9$ Ohm.cm and has a dielectric constant below 3. The suspended toner particles, which usually comprise finely divided pigments (which expression includes dyes in pigment form), obtain an electric charge of a definite polarity by the so-called charge control agent and develop the latent image under influence of the charge of the latent electrostatic image.

The charging of the toner particles can be achieved by the addition of oil-soluble ionogenic substances e.g. metallic salts of organic acids with sufficiently long aliphatic chains. By predominant adsorption of one ionic species the particles receive a net charge, the amount of which can be regulated simply by changing the additive concentration. The polarity is controlled by the appropriate choice of ionogenic substance. For example, a suspension of carbon black in liquid isoparaffins becomes positively charged by calcium diisopropylsalicylate and by the organic phosphorus compounds described in the United Kingdom Pat. No. 1,151,141.

The use of negatively charged toner particle dispersions in which as control agent overbased metal alkyl sulphonates (oil-soluble micells of metal alkyl sulphonates with excess metal hydroxide or carbonate solubilized) are used, has been described in Proc. IEEE, Vol. 60, No. 4, April 1972, page 363 and published German Patent Application (Dt-OS) 1,966,674.

Examples of said metal alkylsulphonates mentioned in the latter Patent Application are basic alkaline earth metal alkylsulphonates such as R-$SO_3$-Ba-O-CO-O-Ba-$SO_3$-R wherein R can be a mixture of various alkyl groups.

According to a further embodiment of said Patent Application, a toner dispersion contains a substance which by the formation of a special adsorption phase enhances the dissociative adsorption of the ionogenic compound and allows the control of such adsorption over a wider range. This substance consists of a soluble, non-ionogenic macromolecular compound whose molecules contain side-chains of at least 4 carbon atoms. As particularly suitable polymers are mentioned substances with side-chains of 10 to 20 carbon atoms. For use in suspensions containing isoparaffines are explicitly mentioned: polymethacrylic acid esters with a molecular weight of $10^4$–$10^7$, polyacrylic acid esters, polyalkylstyrenes, polyvinyl alkyl ethers and copolymers of polymethacrylates with cyclic amides and with fumarates.

A toner developer with toner particles having a negative polarity can be used for direct development of a pattern of positive electrostatic charges or for reversal development of a pattern of negative electrostatic charges such as a pattern resulting from the irradiation of a negatively charged photoconductor surface. In the latter case, the toner is repulsed from the image areas holding negative charges and deposits in the irradiated areas to an extent depending on the charge level differences existing on the surface. In other words, the amount of such negative toner material deposited per increment of surface area is inversely proportional to the magnitude of the negative surface charges retained on the surface.

When attempting to form high density images on a background free of any toner deposit by reversal development of a negative charge pattern using a negative liquid developer, some toner material settles on negative charge-bearing areas, or is attracted by minute charge level differences existing on the irradiated surface, resulting in an undersirable background staining and an overall reduction of contrast, and/or objectionable density variations in the toner image. Minute charge level differences that do not properly belong to the image to be developed are known to occur in particular when using zinc oxide containing photoconductive layers and they can be caused by uneven charging, incorrect exposure, areas of surface breakdown and the like. Particularly in the reproduction of microfilm containing a negative image of an original positive light-image in which the negative image contained in the microfilm is projected onto a negatively charged photoconductive layer, e.g. containing photoconductive zinc oxide and development takes place by means of a negatively charged toner in order to obtain by reversal development a positive reproduction of the original positive light-image, it has proved difficult to obtain a high density developed line image completely free of toner deposit in the image background areas.

The results obtained using a liquid developer composition for developing a given electrostatic charge pattern depend inter alia on the charge level of the toner. For example, in reversal development of a negative electrostatic charge pattern by means of a negative developer, an increase in the charge level on the toner will tend to reduce any tendency for toner to deposit on the charged areas.

The present invention provides liquid developer compositions incorporating a combination of substances serving as dispersing aid and charge control agent, which has been found to enable very useful developer properties to be achieved and in particular a high toner charge level in relation to the amount of control agent employed.

A developer in accordance with the present invention contains in a hydrocarbon liquid having a volume resistivity of at least $10^9$ Ohm.cm and a dielectric constant of less than 3, a suspended negatively charged toner comprising pigment particles, e.g. carbon black particles, bearing organic polymeric material on their surfaces and at least one organic ionic surfactant, wherein the organic ionic surfactant is an oil-soluble overbased alkaline earth metal hydrocarbon sulphonate (e.g. an alkyl aryl sulphonate) in which the alkaline earth metal is magnesium, calcium or barium, the sulphonate has an average molecular weight of at least 800 and the total base number (TBN) of the surfactant determined according to ASTM D 664-58 is at least 2, and wherein the polymeric material is a copolymer of (A) a $C_{12}$–$C_{20}$ alkyl alcohol ester of methacrylic acid and (B) n-butyl or isobutyl alcohol ester of methacrylic acid in which the ratio by weight of (A)/(B) is in the range of 15 to 85 to 85 to 15, or is such copolymer containing in its structure styrene or a styrene homologue e.g. vinyl toluene units up to maximum 70% by weight. In any of such copolymers, methacrylic acid units may be present in minor amount, e.g. in an amount up to 0.4% by weight.

Overbased alkaline earth metal hydrocarbon sulphonates for use according to the present invention may be prepared according to U.S. Pat. No. 3,707,360 and are described for use as corrosion-inhibitors in Ind.Eng. Chem. 46, 5 (1954) p.1035 and 1042.

Developer compositions in accordance with the present invention can be used with advantage for developing electrostatic images comprising image-wise distributed positive charges. At present, however, the developer compositions are considered to afford greater advantages when used for the reversal development of patterns of negative electrostatic charges. In the latter case, the favourable relationship which can be obtained in the developer composition between the amount of charge control agent and the level of charges on the toner can be utilised for developing the negative charge pattern with little or no background staining.

By way of example, a very advantageous development method for reversal development of a negative electrostatic charge pattern comprises carrying out such development by means of a developer composition according to the present invention and wherein the toner material is capable of depositing onto negatively charged areas only if their charge level does not exceed a level corresponding with a voltage difference of 5 V for a capacitance of about $2\times10^{-10}$ F (farad).cm$^{-2}$. The amount of charge control agent can be selected to give this result in any given case.

A suitable amount of the sulphonate for a given toner developer can easily be determined by simple tests. By using said sulphonate as charge control agent, the specified results can be achieved with toner particles of a size commonly used in the electrophotographic art, e.g. with toner particles sizing in the range of 0.1 μm to 2 μm.

Preferred overbased alkaline earth metal hydrocarbon sulphonates are listed in the following Table 1.

Table 1

| Compound no. | Trade name | % by weight metal ion | TBN mg KOH/g | Average molecular weight |
|---|---|---|---|---|
| 1 | TLA-414 | $Ca^{++}$ 16.2% | 400 | >900 |
| 2 | TLA-107 | $Ba^{++}$ 14.2% | 35 | >900 |
| 3 | SINTSUL Mg | $Mg^{++}$ 8-9% | 310 | 920-970 |

TLA-414 is the trade name of a highly overbased calcium hydrocarbon sulphonate marketed by TEXACO Inc., Petro Chemical Dept., 135 East 42nd Street, New York, N.Y. 10017.

TLA-107 is a slightly overbased calcium hydrocarbon sulphonate marketed by the same company.

SINTSUL Mg is the trade name of a highly overbased magnesium hydrocarbon sulphonate marketed by LIQUICHIMICA s.p.a. Milano, Italia.

Preferred copolymers for use according to the present invention have a molecular weight of at least 40,000. Examples of preferred copolymers are listed in Table 2.

Table 2

| Copolymer no. | Trade name | Average molecular weight |
|---|---|---|
| 1 | NEOCRYL B702 | 70,000 |
| 2 | NEOCRYL B707 | 100,000 |
| 3 | PLEXOL 618 | 300,000 |

NEOCRYL B702 is a trade name of Polyvinyl Chemie-Holland, Waalwijk, Netherlands for a copolymer of isobutyl methacrylate, stearyl methacrylate and methacrylic acid. NEOCRYL B702 has the following structure:

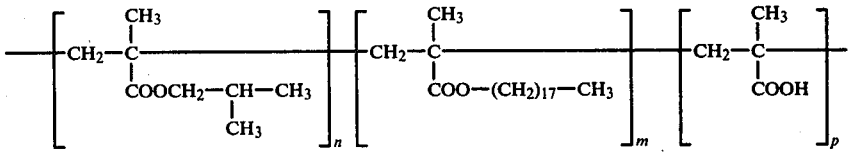

wherein:

n=from 75 to 85% by weight m=15 to 25% by weight p=about 0.2% by weight

NEOCRYL B707 is a trade name of Polyvinyl Chemie-Holland, Waalwijk, Netherlands for a copolymer of m- and p-vinyltoluene, isobutyl methacrylate and stearyl methacrylate corresponding to the following formula:

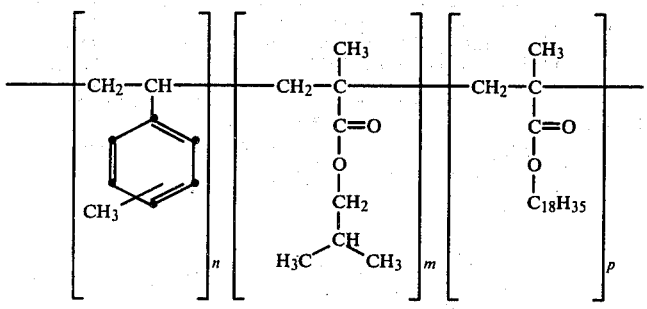

wherein:

n=60% by weight m=20% by weight p=20% by weight

PLEXOL 618 is a trade name of Rohm & Haas, Philadelphia, Pa., USA for a copolymer having the following structure:

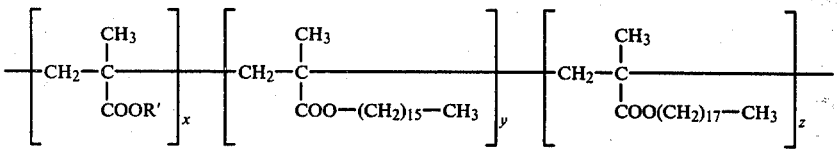

wherein:

R'=n-butyl x=56% by weight y=26% by weight z=18% by weight

The insulating liquid used as a carrier fluid may be any of the conventional electrically insulating carrier liquids generally employed in liquid developer compositions. This liquid may be a hydrocarbon solvent, e.g. an aliphatic hydrocarbon such as hexane, cyclohexane, iso-octane, heptane or isododecane, a fluorocarbon or a silicone oil. Thus, the insulating liquid is, e.g., isododecane or a commercial petroleum distillate, e.g. a mixture of aliphatic hydrocarbons preferably having a boiling range between 150° C. and 220° C. such as the ISOPARS G, H, K and L (trade marks) of Exxon and SHELLSOL T (trade mark) of Shell Oil Company.

The colouring agent used in the toner particles may be any of the pigments and solid dyestuffs commonly employed in liquid electrostatic toner compositions. Thus, for example, use can be made of carbon black and analogous forms thereof e.g. lamp black, channel black and furnace black e.g. Russ Printex 140 geperlt and SPEZIAL SCHWARZ IV (trade names of DEGUSSA-Frankfurt/M, W. Germany).

Very suitable carbon black pigments are marketed by DEGUSSA under the trade name PRINTEX. PRINTEX 140 and PRINTEX G are representatives thereof. The characteristics of preferred carbon blacks are listed in the following Table 3.

Table 3

| | SPEZIAL SCHWARZ IV | PRINTEX 140 | PRINTEX G |
|---|---|---|---|
| origin | oxidized channel black | channel black | furnace black |
| density | 1.8 g.cm$^{-3}$ | 1.8 g.cm$^{-3}$ | 1.8 g.cm$^{-3}$ |
| grain size before entering the developer | 25 nm | 29 nm | 51 nm |
| oil number (g of linseed oil adsorbed by 100 g of pigment) | 300 | 360 | 250 |
| specific surface (sq.m per g) | 180 | 96 | 31 |
| volatile material % by weight | 14 | 6 | 2 |
| pH | 3 | 5 | 8 |
| colour | brown-black | brown-black | bleu-black |

As colour corrector for the carbon black pigments preferably minor amounts of copper phthalocyanine are used, e.g. from 1 to 20 parts by weight with respect to the carbon black.

The organic polymeric material on the pigment particles operates as a dispersing aid and agent controlling the adsorption of the charge determining ionic species of the ionogenic surfactant. In addition, the coating of the described polymeric material confers on the toner developers a better shelf life stability.

The organic polymers may be used in amounts of between 10% to 500% by weight with respect to the total weight of pigment particles, preferably between 20% and 200% by weight.

The polymeric material is preferably introduced as a separate ingredient in the developer liquid and allowed to become adsorbed onto the pigment particles.

It is generally suitable for the electrophoretic liquid developer to incorporate the toner in an amount between 0.1 g and 20 g per liter, preferably between 0.5 g and 10 g per liter.

The alkaline earth metal hydrocarbon sulphonates are preferably used in the range of 1 to 250% by weight with respect to the pigment particles, more preferably in a range of 10 to 100% by weight.

The liquid developer composition can be prepared by using dispersing and mixing techniques well known in the art. It is conventional to prepare by means of suitable mixers e.g. a 3-roll mill, ball mill, colloid mills, high speed stirrers, a concentrate e.g. 15 to 80% by weight of solids in the insulating carrier liquid of the materials selected for the composition and subsequently to add further insulating carrier liquid to provide the liquid toner composition ready for use in the electrostatic reproduction process.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients, which may be of interest, e.g., in certain medical X-ray images for diagnostic purposes.

The following examples illustrate the present invention. The percentages and ratios are by weight unless otherwise indicated

EXAMPLE 1

In a ball-mill the following products were introduced successively:

50 ml of 10% solution of TLA-414 (trade name) (total base number: 400) in isododecane.

2 g of PRINTEX G (trade name).

This mixture was ground for 15 h and thereupon diluted with isododecane so as to obtain a toner dispersion having 0.4 g per liter of carbon black with mean grain size of 0.36 μm.

By tests carried out in an electrophoresis cell, it could be determined that actually only 75% of the toner particles had a negative charge. To said toner dispersion 1.5 g of NEOCRYL B 702 (trade name) were added. After an additional 2 hours of ball-milling 10 ml of dispersion were diluted with 1 liter of isododecane so as to obtain the working developer. The mean diameter of the toner particles was now 0.31 μm. By tests carried out in an electrophoresis cell it could be determined that all particles were negatively charged.

This developer was used for reversal development of a negatively charged image obtained on a photoconductive zinc oxide coating by exposure through a negative microfilm halftone image.

The photoconductive layer was initially charged up to a charge level of 300 V for a capacitance of about $2\times10^{-10}$ F.cm$^{-2}$. In the exposed portions, the charge level was dropped to about 5 V. A clear image background was obtained.

The visible image obtained had only straight graininess, a good uniformity and an optical density equal to 1.0 (measured by reflected light).

The storage keepability of the above prepared developer was more than 5 months.

EXAMPLE 2

In a ball-mill, the following ingredients were introduced successively:

| | |
|---|---|
| NEOCRYL B 702 (trade name) | 1.0 g |
| PRINTEX G (trade name) | 4.0 g |
| TLA-414 (trade name) | 0.04 g |
| isododecane | 46 ml |

After 15 h of ball-milling, 10 ml of dispersion were diluted with 1 liter of isododecane. The average diameter of the negatively charged toner particles was 0.42 μm.

The obtained developer is particularly useful in electrophoretic development to produce toner images that can be transferred from a smooth surface, e.g. a resin surface, to plain paper.

EXAMPLE 3

In a ball-mill, the following ingredients were introduced successively:

| | |
|---|---|
| NEOCRYL B 702 (trade name) | 1.5 g |
| PRINTEX G (trade name) | 2 g |
| TLA-256 (trade name) | 0.5 g |
| isododecane | 47 ml |

After 15 h of ball-milling, 10 ml of the obtained toner concentrate were diluted with 1 liter of isododecane. The average diameter of the negatively charged toner particles was 0.50 μm.

EXAMPLE 4

In a ball-mill, the following ingredients were introduced successively:

| | |
|---|---|
| PLEXOL 618 (trade name) | 10 g |
| PRINTEX G (trade name) | 2 g |
| TLA-414 (trade name) | 0.4 g |
| isododecane | 39 ml |

After 15 h of ball-milling, 10 ml of the obtained toner concentrate was diluted with 1 liter of isododecane.

The negatively charged toner is suited for reversal development and is self-fixing.

EXAMPLE 5

In a ball-mill, the following ingredients were introduced successively:

| | |
|---|---|
| NEOCRYL B 707 (trade name) | 1.5 g |
| PRINTEX G (trade name) | 2 g |
| TLA-414 (trade name) | 0.4 g |
| isododecane | 46 ml |

The average diameter of the negatively charged toner particles was 0.27 μm. The toner adhered perfectly to photoconductive zinc oxide coatings.

EXAMPLE 6

In a ball-mill, the following ingredients were introduced successively:

| | |
|---|---|
| NEOCRYL B 702 (trade name) | 1.5 g |
| SPEZIAL SCHWARZ IV (trade name) | 2 g |
| TLA-414 (trade name) | 0.4 g |
| isododecane | 47 ml |

A toner dispersion of very good stability containing toner particles having an average diameter of 0.25 μm was obtained.

We claim:

1. A liquid developer composition suitable for rendering visible in the direct or reversed sense electrostatic charge patterns contained on a surface, which composition contains in a hydrocarbon liquid having a volume resistivity of at least $10^9$ Ohm.cm and a dielectric constant of less than 3, a negatively charged suspended toner comprising organic polymer-coated pigment particles and at least one organic ionic surfactant, wherein (1) said organic ionic surfactant consists essentially of an oil-soluble overbased alkaline earth metal hydrocarbon sulphonate wherein the alkaline earth metal is magnesium, calcium or barium, the sulphonate has an average molecular weight of at least 800, and the total base number (TBN) of the surfactant determined according to ASTM D 664-58 is at least 2, and (2) the polymeric material consists essentially of a copolymer of (A) a $C_{12}$–$C_{20}$ alkyl alcohol ester of methacrylic acid and (B) n-butyl or isobutyl alcohol ester of methacrylic acid, in which the ratio by weight of (A)/(B) is in the range of 15 to 85/85 to 15, or a copolymer (containing in its structure) of said (A) and (B) and (C) styrene or a styrene homologue in which (C) is present up to a maximum of 70% by weight, said copolymer in either case containing up to 0.4% by weight of methacrylic acid units.

2. A liquid developer composition according to claim 1, wherein the pigment particles are carbon black particles.

3. A liquid developer composition according to claim 2, wherein the carbon black particles are mixed with copper phthalocyanine particles to obtain a more neutral black colour tone of deposited toner.

4. A liquid developer composition according to claim 1, wherein the hydrocarbon liquid is an aliphatic hydrocarbon.

5. A liquid developer composition according to claim 1, wherein the negatively charged toner particles have a size in the range of 0.1 to 2 $\mu$m.

6. A liquid developer composition according to claim 1, wherein the alkaline earth metal hydrocarbon sulphonate is present in an amount of from 1.0 to 250% by weight with respect to the total weight of the pigment particles.

7. A liquid developer composition according to claim 1, wherein the polymeric coating constitutes about 10% - 500% by weight of said pigment particles.

8. A liquid developer composition according to claim 1, wherein the toner particles are present in an amount between 0.1 g and 20 g per liter.

9. A liquid developer according to claim 1, wherein said oil-soluble overbased alkaline earth metal hydrocarbon sulphonate is an oil-soluble overbased alkaline earth metal alkyl aryl sulphonate.

10. A method of reversal developing a negative electrostatic charge pattern on a surface, which method comprises contacting said surface with a liquid developer composition suitable for rendering visible in the reversed sense electrostatic charge patterns contained on a surface, which composition comprises a hydrocarbon liquid having a volume resistivity of at least $10^9$ Ohm.cm and a dielectric constant of less than 3, a negatively charged suspended toner comprising organic polymer-coated pigment particles and at least one organic ionic surfactant, wherein (1) said organic ionic surfactant consists essentially of an oil-soluble overbased alkaline earth metal hydrocarbon sulphonate wherein the alkaline earth metal is magnesium, calcium or barium, the sulphonate has an average molecular weight of at least 800, and the total base number (TBN) of the surfactant determined according to ASTM D 664-58 is at least 2, and (2) the polymeric material consists essentially of a copolymer of (A) a $C_{12}$–$C_{20}$ alkyl alcohol ester of methacrylic acid and (B) n-butyl or iosbutyl alcohol ester of methacrylic acid, in which the ratio by weight of (A)/(B) is in the range of 15 to 85/85 to 15; or a copolymer of said (A) and (B) and (C) styrene or a styrene homologue in which (C) is present up to a maximum of 70% by weight, said copolymer in either case containing up to 0.4% by weight of methacrylic acid units.

* * * * *